US012716184B2

(12) United States Patent
Mantovani

(10) Patent No.: US 12,716,184 B2
(45) Date of Patent: Aug. 25, 2026

(54) SNOW MELTING SURFACE

(71) Applicant: Vincent Mantovani, Derby, CT (US)

(72) Inventor: Vincent Mantovani, Derby, CT (US)

( * ) Notice: Subject to any disclaimer, the term of this patent is extended or adjusted under 35 U.S.C. 154(b) by 326 days.

(21) Appl. No.: 18/381,885

(22) Filed: Oct. 19, 2023

(65) Prior Publication Data

US 2025/0129560 A1 Apr. 24, 2025

(51) Int. Cl.
*E01H 5/10* (2006.01)

(52) U.S. Cl.
CPC ..... *E01H 5/104* (2013.01)

(58) Field of Classification Search
CPC ..... E01H 5/10; E01H 5/102; E01H 5/104
See application file for complete search history.

(56) References Cited

U.S. PATENT DOCUMENTS 2,844,696 A * 7/1958 Custer, Jr. ..... H05B 3/342 219/217
6,051,811 A * 4/2000 Hardison ..... H05B 3/36 135/119
6,184,496 B1 * 2/2001 Pearce ..... E01C 11/265 219/202
7,628,150 B2 * 12/2009 Malkov ..... A01G 13/06 126/271.2 A
10,920,379 B2 * 2/2021 Naylor ..... H05B 3/36
2004/0035853 A1 * 2/2004 Pais ..... H05B 3/36 392/432
2004/0099654 A1 * 5/2004 Pais ..... F24D 19/1096 219/486
2016/0100457 A1 * 4/2016 Cole ..... E01H 5/10 219/213
2020/0190757 A1 * 6/2020 Gilot ..... H05B 3/20
2021/0115637 A1 * 4/2021 Caviness ..... E01H 5/102

* cited by examiner

*Primary Examiner* — Matthew R Buck
(74) *Attorney, Agent, or Firm* — The Iwashko Law Firm, PLLC; Lev Ivan Gabriel Iwashko

(57) ABSTRACT

A snow melting surface to be disposed on an external surface, the snow melting surface including a main body to cover the external surface, a heating coil disposed within at least a portion of the main body to increase a temperature level of the main body in response to the heating coil being turned on, and a liquid collection compartment disposed on at least a portion of main body to store at least one liquid created from melting of frozen precipitation disposed on the main body.

5 Claims, 2 Drawing Sheets

SNOW MELTING SURFACE

BACKGROUND

1. Field

The present general inventive concept relates generally to snow management, and particularly, to a snow melting surface.

2. Description of the Related Art

Certain locations are more prone to receiving wintry weather during the winter season. In particular, snow, sleet, freezing rain, and/or a combination of those elements can cause difficulty for a homeowner. The wintry precipitation can make a driveway slippery and hazardous to traverse.

Most homeowners will have to shovel the snow and/or sleet to clean the driveway and allow it to be used for vehicles. However, shoveling is often labor intensive, tiresome, and time-consuming. Also, shoveling the snow and/or sleet will cause a buildup of the snow and/or the sleet at another location on the homeowner's property, which can be difficult to manage.

Therefore, there is a need for a snow melting surface that eliminates accumulation of wintry precipitation on the driveway and/or a roof of a home.

SUMMARY

The present general inventive concept provides a snow melting surface.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a snow melting surface to be disposed on an external surface, the snow melting surface including a main body to cover the external surface, a heating coil disposed within at least a portion of the main body to increase a temperature level of the main body in response to the heating coil being turned on, and a liquid collection compartment disposed on at least a portion of main body to store at least one liquid created from melting of frozen precipitation disposed on the main body.

The heating coil may increase the temperature level of the main body to a predetermined limit.

The snow melting surface may further include a hose connected to at least a portion of the liquid collection compartment to facilitate extraction of the at least one liquid away from the liquid collection compartment.

The snow melting surface may further include a plurality of guide rails disposed within at least a portion of the main body to direct movement of the at least one liquid within the main body toward the liquid collection compartment.

The snow melting surface may further include a plurality of support beams disposed within at least a portion of the main body and extending from a first side of the main body to a second side of the main body to stabilize a shape of the main body.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Snow Melting Surface 100
Main Body 110

Heating Coil 120
Liquid Collection Compartment 130
Hose 140
Guide Rails 150
Power Cord 160
Support Beams 170

Figure 1:
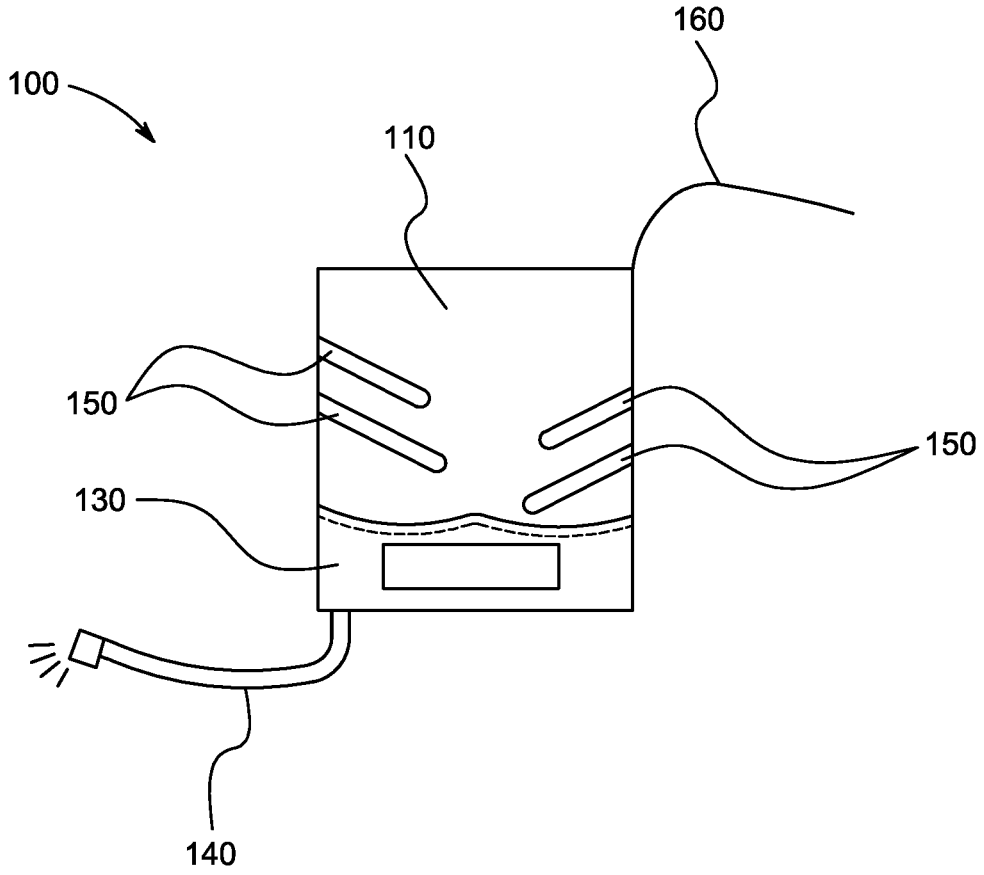
FIG. 1 illustrates an elevational top view of a snow melting surface, according to an exemplary embodiment of the present general inventive concept.

FIG. 1 illustrates an elevational top view of a snow melting surface 100, according to an exemplary embodiment of the present general inventive concept.

Figure 2:
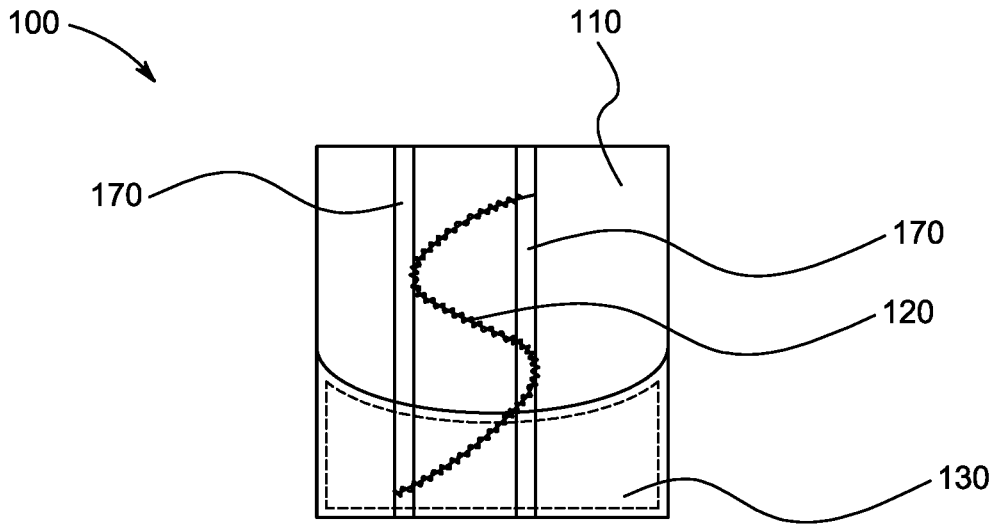
FIG. 2 illustrates a sectional view of the snow melting surface, according to an exemplary embodiment of the present general inventive concept.

FIG. 2 illustrates a sectional view of the snow melting surface 100, according to an exemplary embodiment of the present general inventive concept.

The snow melting surface 100 may be constructed from at least one of metal, plastic, wood, and rubber, etc., but is not limited thereto.

Referring to FIGS. 1 and 2, the snow melting surface 100 may include a main body 110, a heating coil 120, a liquid collection compartment 130, a hose 140, a plurality of guide rails 150, a power cord 160, and a plurality of support beams 170, but is not limited thereto.

Referring again to FIGS. 1 and 2, the main body 110 is illustrated to have a rectangular shape. However, the main body 110 may be circular, triangular, pentagonal, hexagonal, heptagonal, octagonal, or any other shape known to one of ordinary skill in the art, but is not limited thereto.

The main body 110 may be a tarp, a mat, a blanket, a carpet, and/or any other type of surface to cover an external surface (e.g., a driveway, a roof). The main body 110 may be highly durable and/or heat resistant. In other words, the main body 110 may withstand high temperatures that would burn and/or melt the material.

The heating coil 120 may be disposed within at least a portion of an interior of the main body 110. The heating coil 120 may increase a temperature level thereof in response to being turned on. Moreover, the heating coil 120 may be preconfigured to increase the temperature level to a predetermined limit. For example, the heating coil 120 may increase the temperature level to fifty (50) degrees Fahrenheit. In other words, the heating coil 120 may increase the temperature level enough to melt snow, sleet, and/or freezing rain, but not enough to burn and/or injure a person and/or an animal.

Also, the heating coil 120 may have a particular shape (e.g., an S-shape) to maximize coverage of changes of the temperature level within the main body 110.

Furthermore, the heating coil 120 may increase a temperature level of the main body 110. As such, the main body 110 may heat up in response to the increase in the temperature level of the heating coil 120. Accordingly, the main body 110 may melt and/or eliminate accumulation of frozen precipitation, such as snow, sleet, ice, and/or freezing rain.

The liquid collection compartment 130 may be disposed on and/or within at least a portion of main body 110. The liquid collection compartment 130 may receive and/or store at least one liquid (e.g., water, melting snow, melting ice, etc.) therein. Thus, the liquid collection compartment 130 may receive the at least one liquid from the melting of the frozen precipitation on the main body 110.

The hose 140 may be connected to at least a portion of the liquid collection compartment 130. The hose 130 may facilitate extraction of the at least one liquid away from the liquid collection compartment 130. In other words, the hose 130 may drain the at least one liquid from the liquid collection compartment 130 to empty the liquid collection compartment 130.

Alternatively, there may be a plurality of hoses 140 connected to the liquid collection compartment 130 to extract a greater volume of the at least one liquid over a given time period.

The plurality of guide rails 150 may be disposed within at least a portion of the interior of the main body 110. Each of the plurality of guide rails 150 may direct movement of the at least one liquid within the main body 110 toward the liquid collection compartment 130. Thus, collectively, the plurality of guide rails 150 may funnel the at least one liquid toward the liquid collection compartment 130. Moreover, the plurality of guide rails 150 may optimally operate where the main body 110 is disposed on an inclined surface (e.g., a driveway on a hill, the roof).

The power cord 160 may be disposed on at least a portion of the main body 110 and/or connected to the heating coil 120. The power cord 160 may provide power to the heating coil 120 in response to being inserted into an electrical outlet.

Alternatively, and/or in addition thereto, the power cord 160 may be a power source 160, which may include a battery and a solar cell. In other words, the battery may operate independently of the electrical outlet. Also, the solar cell may provide power to the battery in response to receiving light from a light source (e.g., Sun, external light source).

The plurality of support beams 170 may be disposed on and/or within at least a portion of the interior of the main body 110. Additionally, each of the plurality of support beams 170 may extend from a first side of the main body 110 to a second side of the main body 110 opposite with respect to the first side of the main body 110. Each of the plurality of support beams 170 may stabilize and/or support a structure (i.e., shape) of the main body 110.

Therefore, the snow melting surface 100 may be used to cover the driveway and/or a roof of a home to eliminate accumulation of the frozen precipitation. Also, the snow melting surface 100 may save a homeowner from having to shovel the frozen precipitation.

The present general inventive concept may include a snow melting surface 100 to be disposed on an external surface, the snow melting surface 100 including a main body 110 to cover the external surface, a heating coil 120 disposed within at least a portion of the main body 110 to increase a temperature level of the main body 110 in response to the heating coil 120 being turned on, and a liquid collection compartment 130 disposed on at least a portion of main body 110 to store at least one liquid created from melting of frozen precipitation disposed on the main body 110.

The heating coil 120 may increase the temperature level of the main body 110 to a predetermined limit.

The snow melting surface 100 may further include a hose 140 connected to at least a portion of the liquid collection compartment 130 to facilitate extraction of the at least one liquid away from the liquid collection compartment 130.

The snow melting surface 100 may further include a plurality of guide rails 150 disposed within at least a portion of the main body 110 to direct movement of the at least one liquid within the main body 110 toward the liquid collection compartment 130.

The snow melting surface 100 may further include a plurality of support beams 170 disposed within at least a portion of the main body 110 and extending from a first side of the main body 110 to a second side of the main body 110 to stabilize a shape of the main body 110.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A snow melting surface to be disposed on an external surface wherein the external surface is at least one of a driveway and a roof, the snow melting surface comprising:

a main body to contact and cover the external surface, wherein the main body is heat resistant and is at least one of a tarp, a mat, a blanket, and a carpet;

a heating coil disposed within at least a portion of the main body to increase a temperature level of the main body in response to the heating coil being turned on; and a liquid collection compartment disposed on at least a portion of the main body to store at least one liquid created from melting of frozen precipitation disposed on the main body.

2. The snow melting surface of claim 1, wherein the heating coil increases the temperature level of the main body to a predetermined limit.

3. The snow melting surface of claim 1, further comprising:

a hose connected to at least a portion of the liquid collection compartment to facilitate extraction of the at least one liquid away from the liquid collection compartment.

4. The snow melting surface of claim 1, further comprising:

a plurality of guide rails disposed within at least a portion of the main body to direct movement of the at least one liquid within the main body toward the liquid collection compartment.

5. The snow melting surface of claim 1, further comprising:

a plurality of support beams disposed within at least a portion of the main body and extending from a first side of the main body to a second side of the main body to stabilize a shape of the main body.

* * * * *